US010212997B1

(12) United States Patent
Hsieh

(10) Patent No.: US 10,212,997 B1
(45) Date of Patent: Feb. 26, 2019

(54) COLLAPSIBLE UMBRELLA WITH AUTOMATIC CLOSING STRUCTURE

(71) Applicant: Ming-Ta Hsieh, Taoyuan (TW)

(72) Inventor: Ming-Ta Hsieh, Taoyuan (TW)

( * ) Notice: Subject to any disclaimer, the term of this patent is extended or adjusted under 35 U.S.C. 154(b) by 0 days.

(21) Appl. No.: 15/852,034

(22) Filed: Dec. 22, 2017

(30) Foreign Application Priority Data

Nov. 22, 2017 (TW) ..... 106217358 U

(51) Int. Cl.
*A45B 25/14* (2006.01)
*A45B 19/04* (2006.01)
*A45B 19/10* (2006.01)

(52) U.S. Cl.
CPC ..... *A45B 25/143* (2013.01); *A45B 19/04* (2013.01); *A45B 19/10* (2013.01)

(58) Field of Classification Search
CPC ..... A45B 19/04; A45B 19/10; A45B 25/143
See application file for complete search history.

(56) References Cited

U.S. PATENT DOCUMENTS 1,969,821 A * 8/1934 Saxon ..... A45B 19/04 135/26
2,671,460 A * 3/1954 Taseos ..... A45B 19/10 135/25.32
3,411,519 A * 11/1968 Weber ..... A45B 19/04 135/26
3,921,655 A * 11/1975 Weber ..... A45B 19/10 135/25.1
2006/0201543 A1* 9/2006 Wu ..... A45B 19/04 135/22
2015/0208772 A1* 7/2015 You ..... A45B 19/04 135/15.1

FOREIGN PATENT DOCUMENTS

AT 306275 B * 4/1973 ..... A45B 19/04
JP 2000102407 A * 4/2000 ..... A45B 19/04

* cited by examiner

*Primary Examiner* — Noah Chandler Hawk
(74) *Attorney, Agent, or Firm* — Rosenberg, Klein & Lee

(57) ABSTRACT

A collapsible umbrella with automatic closing structure has an extendable rod automatically retracting toward a runner away from its users by pressing of a button. The extendable rod includes an outer tube, an intermediate tube, an inner tube and a first spring. The tubes respectively have one, two, and three groove sections along outer peripheries thereof. A runner of the collapsible umbrella has axial protrusion to release a resilient section of a first clip from a first slot hole, thereby retracting a first spring for the intermediate tube being retracted into the outer tube; then a resilient section of a second clip is released from a second slot hole, thereby retracting the inner tube into the intermediate tube. The structure enables the users to close and fold the collapsible umbrella with single hand and has the extendable rod closing in a direction away from the users, so as to prevent from splashes of the rain and potential injuries during the retracting and folding.

6 Claims, 17 Drawing Sheets

COLLAPSIBLE UMBRELLA WITH AUTOMATIC CLOSING STRUCTURE

BACKGROUND OF THE INVENTION

1. Field of the Invention

The present invention relates to a collapsible umbrella with automatic closing structure, particularly to one that retracts an extendable rod from a handle toward a runner for the collapsible umbrella to be closed in a direction away from its users.

2. Description of the Related Art

Referring to FIGS. 1 and 2, a conventional collapsible umbrella with automatic closing structure mainly comprises a plurality of ribs 11, a cap 12, a runner 13, a rod 14, a handle 15 and a pulley structure 16. Each rib 11 is connected to both the cap 12 and the runner 13 and includes a retracting spring 111. The rod 14 includes an inner tube 141, a middle tube 142 and an outer tube 143. The pulley structure 16 includes a first pulley rope 161 and a second pulley rope 162; the first pulley rope 161 is operated with a first pulley wheel 163 arranged above the outer tube 143 and has an end fixed at a top end of the middle tube 142 and another end fixed on the runner 13; the second pulley rope 162 is operated with a second pulley wheel 164 arranged above the middle tube 142 and has an end fixed at a top end of the inner tube 141 and another end fixed at a bottom end of the outer tube 143. A middle spring 17 is disposed in the middle tube 142 with an end of the middle spring 17 fixed at the top end of the middle tube 142 and another end of the middle spring 17 fixed at the top end of the inner tube 141. The inner tube 141 further has a positioning portion 18 having a first end 181 to engage in a positioning space 191 of a middle section 19 between the middle tube 142 and the inner tube 141 when opening the umbrella and a second end 182 disposed in the handle 15; the handle 15 further has a bottom spring 151 and a button 152 corresponding to position of the second end 182. Thereby the umbrella is opened when the runner 13 is pushed toward the cap 12 by human hand, stretching the ribs 13 and extending the rod 14 by the pulley structure 16 until the first end 181 of the positioning portion 18 is fixedly engaging in the positioning space 191; and the umbrella is closed when button 152 on the handle 15 release engagement of the positioning portion 18, retracting the rod 14 toward the handle 15 by the middle spring 17 and the pulley structure 16 and retracting the ribs 11 by the retracting springs 111 until the umbrella is fully closed.

However, when closing the collapsible umbrella, the button 152 on the handle 15 is pressed to release engaged status of the positioning portion 18 and retract the rod 14 by the middle spring 17 and the pulley structure 16 as the retracting spring 111 of the runner 13 retracting and folding up the ribs 11. Specifically, both the rod 14 and the ribs 11 are retracted toward the users, and it requires great elasticity for the middle spring 17 to retract both the rod 14 and the ribs 11. Such structures for closing umbrellas, collapsible or not, are common in the field, but when closing umbrellas with such structures, the rain drops are splashed onto the users and there is a great possibility of the ribs hurting the users with the strong elasticity of the spring. In addition, the pulley structure is complicated in the manufacturing process and also easily damaged.

SUMMARY OF THE INVENTION

A primary objective of the present invention is to provide a collapsible umbrella with automatic closing structure that can be closed single-handed and that closes in a direction away from its users.

Another objective of the present invention is to provide a collapsible umbrella with automatic closing structure that has fixing and engaging elements arranged in groove sections without stretching or extending out from an outer periphery of an extendable rod to prevent from possible injuries for its users.

To achieve the objectives mentioned above, the present invention comprises an extended rod including an outer tube, an intermediate tube, an inner tube, and a first spring, wherein the outer tube includes an engaging hole on a periphery near a top thereof, a first groove section axially arranged along an outer periphery of the outer tube and a first slot hole arranged at near bottom of the first groove section; the intermediate tube is engaged in an inner periphery of the outer tube and includes a second groove section axially arranged along an outer periphery thereof corresponding to the first groove section, a first through hole arranged near a top of the second groove section corresponding to the first slot hole, a second slot hole arranged near a bottom of the second groove section, a third groove section arranged axially along the outer periphery of the intermediate tube and parallel with the second groove section, and a first positioning joint disposed within the intermediate tube at a top thereof and including a first axial through-hole and a first clip arranged on a periphery wall thereof, said first clip including a resilient section protruding out the first through hole and the second groove section without extending over the periphery of the intermediate tube and engaging the first slot hole of the outer tube for fixing a position when the intermediate tube is retracted within the outer tube; the inner tube includes a fourth groove section arranged along an outer periphery thereof corresponding to the second groove section, a second through hole arranged near a top of the fourth groove section corresponding to the second slot hole, a fifth groove section axially arranged along the outer periphery of the inner tube corresponding to the third groove section, a sixth groove section axially arranged along the outer periphery of the inner tube, and a second positioning joint disposed within the inner tube at a top thereof, said second positioning joint including a second axial through-hole and a second clip arranged on a periphery wall thereof, said second clip including a resilient section protruding out the second through hole and the fourth groove section without extending over the periphery of the inner tube and engaging the second slot hole of the intermediate tube for fixing a position when the inner tube is retracted within the intermediate tube and the outer tube; the first spring has a top end passing through the first axial through-hole to fixedly engage in the outer tube and a bottom end passing through the second axial through-hole to fixedly engage in the inner tube;

a handle engaged a bottom end of the inner tube by a fixing section, said fixing section including a lower fastening element;

a top cap mounted on a top end of the outer tube and including an upper fastening element, said upper fastening element further having a seventh groove section arranged along an outer periphery of a lower part of the upper fastening element corresponding to the first groove section of the outer tube for the upper fastening element to be mounted and fixed thereon;

a runner engaged on the outer peripheral of the outer tube and including a button, a latch arranged at a bottom end of the button for fixing a position of the button when the runner is pushed toward the top cap, and an axial protrusion arranged axially along an inner periphery of the runner for pressing the resilient section of the first clip inwardly to be released from the first slot hole, thereby retracting the intermediate tube back into the outer tube, and then pressing the resilient section of the second clip inwardly by the intermediate tube to be released from the second slot hole, thereby retracting the inner tube into the intermediate tube when the runner slides downwards along the outer tube; and an upper part including a plurality of radially arranged ribs and a piece of covering fabric, each rib having a first engaging end, a second engaging end and a second spring, said first engaging ends engaging the top cap and said second engaging ends engaging the runner.

Whereby the collapsible umbrella is opened by having the handle held by one hand and the runner pushed by another hand for sliding toward the top cap to displace the plurality of ribs for stretching the second springs, displace the outer tube away from the handle and stretch the first spring in the extendable rod until the latch engages in the engaging hole for positioning the runner at a position near a top end of the outer tube, the resilient section of the first clip engaging in the first slot hole for the intermediate tube to stretch out from the outer tube, and the resilient section of the second clip engaging in the second slot hole for the inner tube to stretch out from the intermediate tube, thereby the extendable rod is fully extended, the covering fabric is unfolded, and the collapsible umbrella is opened; and the collapsible umbrella is closed by having one hand holding the runner and pressing the button on the runner to release the engaging status of the latch from the engaging hole, retract the second springs, and fold back the covering fabric, then a bottom end of the outer tube displacing toward the runner, the resilient section of the first clip being released from the first slot hole by the axial protrusion of the runner and the intermediate tube being retracted back inside the outer tube by the first spring to fully retract the extendable rod and close the collapsible umbrella.

With structures disclosed above, the present invention has the outer tube, intermediate tube and the inner tube respectively arranged with one, two and three groove sections. When the runner is operated for displacement, the axial protrusion releases the resilient section of the first clip from the first slot hole; since the engaging elements are arranged in the groove sections, it is safe for a user to close the collapsible umbrella. In addition, the closing of the collapsible umbrella is operated in a direction away from its users, avoiding splash by the rain of injury by the collapsible umbrella when closing it. Still, the first spring only functions to retract the intermediate tube and the inner tube. Therefore, the elasticity required in the present invention is much less than a conventional collapsible umbrella and the closing structure is easier as well.

DETAILED DESCRIPTION OF THE PREFERRED EMBODIMENT

Figure 1:
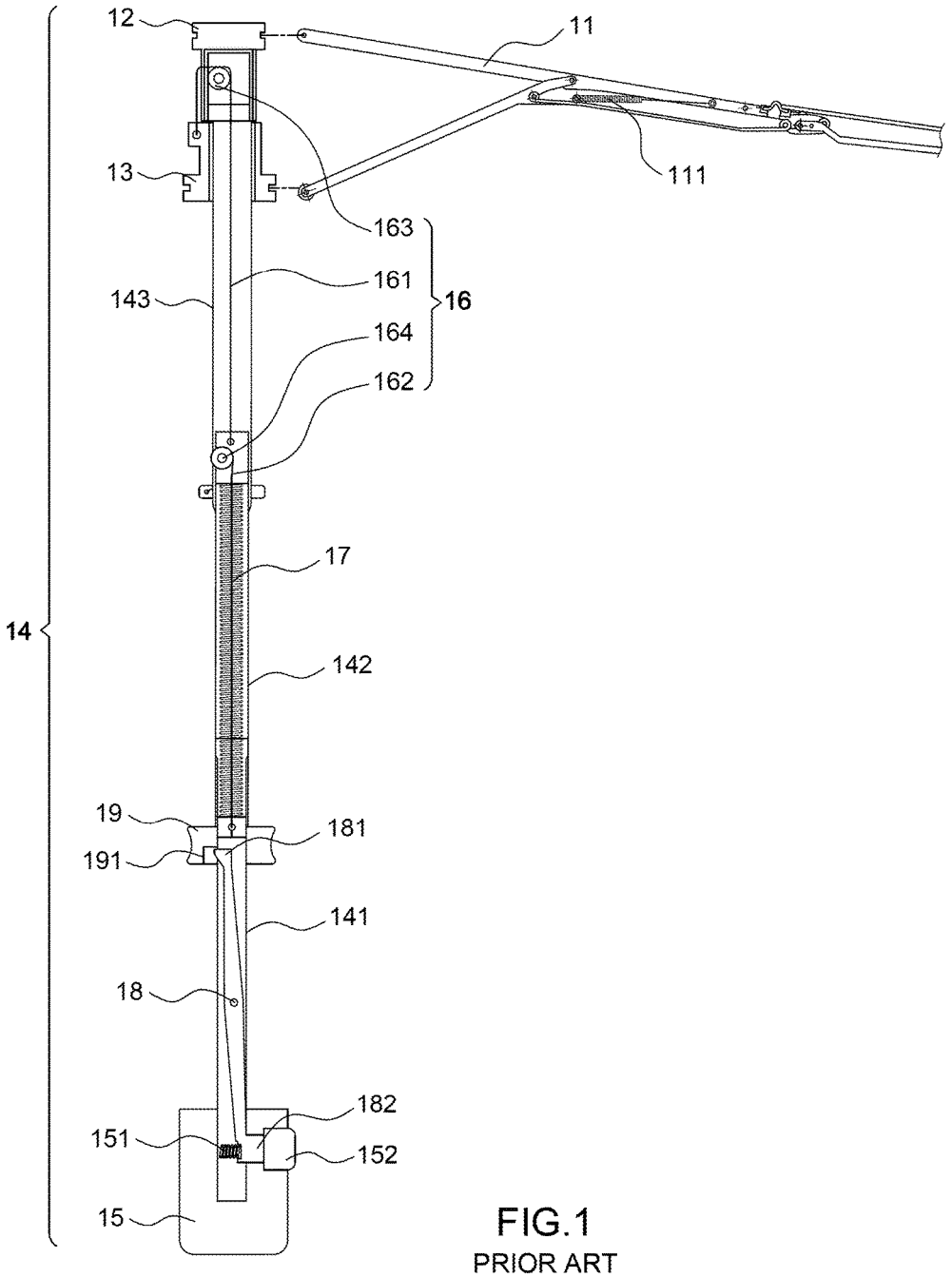
FIG.1 PRIOR ART
FIG. 1 is a schematic diagram illustrating structure of an opened collapsible umbrella according to the prior art.
Figure 2:
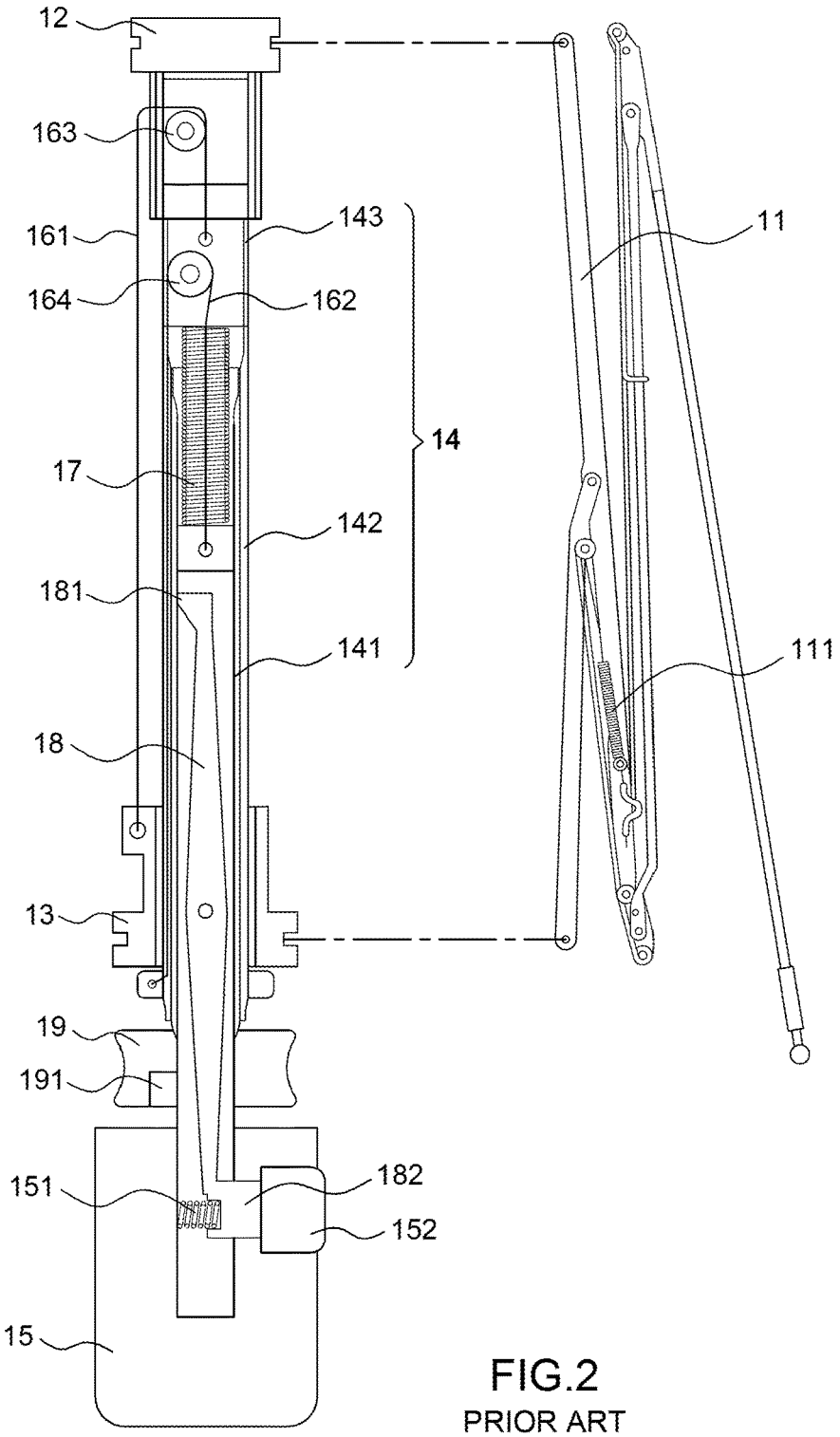
FIG.2 PRIOR ART
FIG. 2 is a schematic diagram illustrating structure of a closed collapsible umbrella according to the prior art.

Referring to FIGS. 3-15, a collapsible umbrella with automatic closing structure mainly comprises an extendable rod 20, a handle 30, a top cap 40, a runner 50, and an upper section 60.

The extendable rod 20 includes an outer tube 21, an intermediate tube 22, an inner tube 23, and a first spring 24. In this embodiment, the outer tube 21, the intermediate tube 22, and the inner tube 23 polygonal tubes but they are not limited to such application; the tubes can be are circular tubes as well. In the Drawings, a front of the extendable rod 20 is in a Y-direction and a rear of the extendable rod 20 is in an opposite direction to the Y-direction.

Figure 4A:
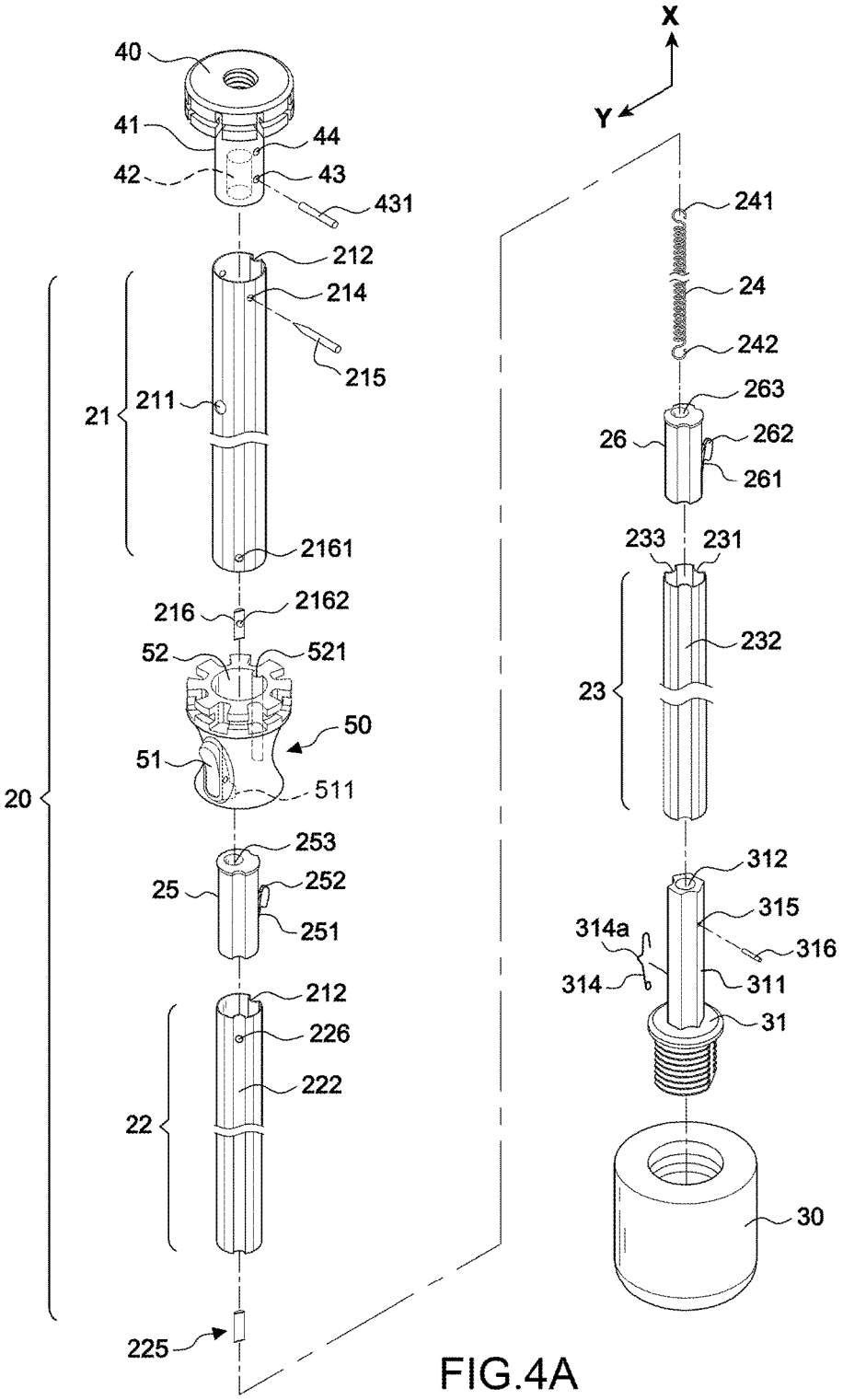
FIG. 4A is an exploded view of structures along an extendable rod of the present invention.
Figure 4B:
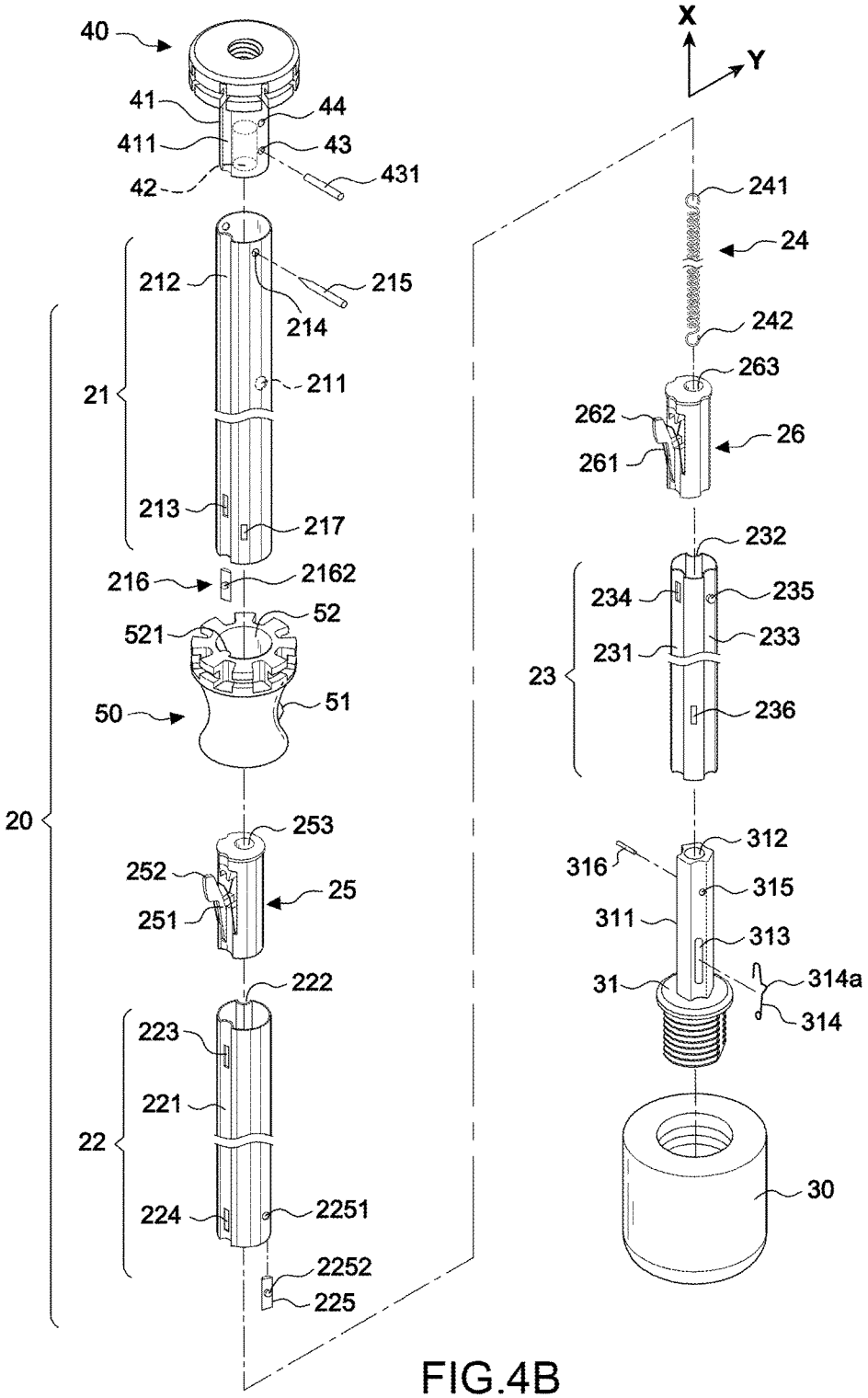
FIG. 4B is another exploded view of structures along the extendable rod of the present invention viewing from an opposite direction.
Figure 5A:
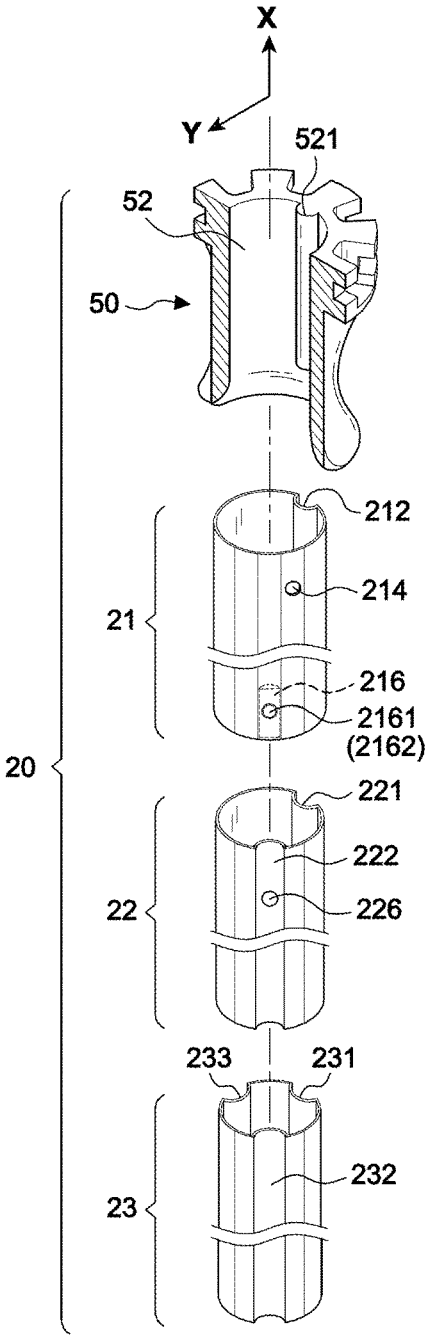
FIG. 5A is a partially enlarged view of main components in FIG. 4A.
Figure 5B:
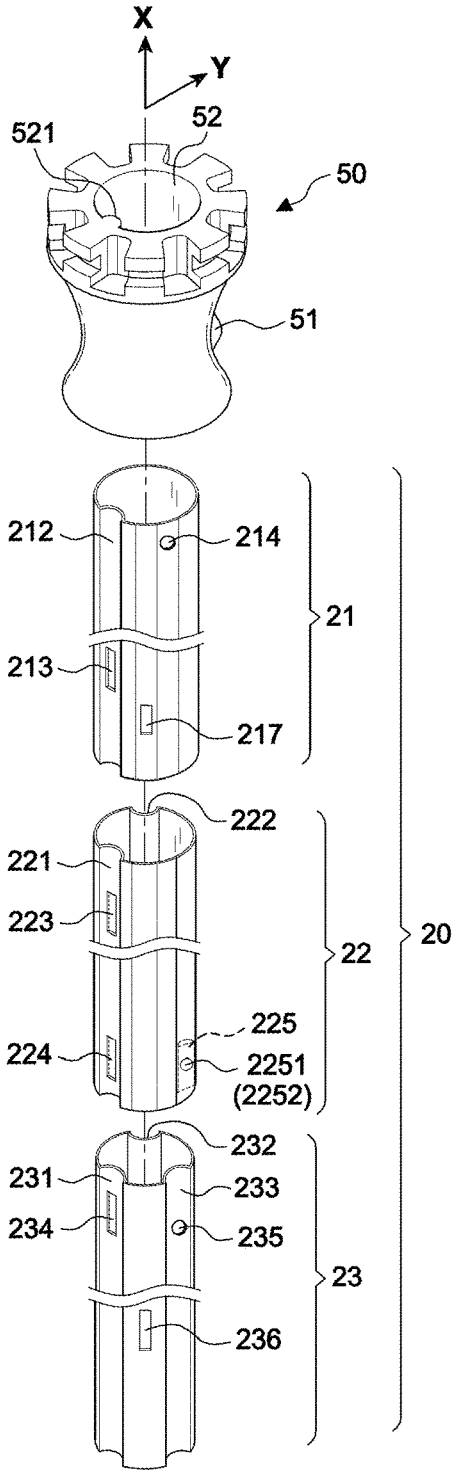
FIG. 5B is a partially enlarged view of main components in FIG. 4B.

Referring to FIGS. 4A, 4B, and 5B, the outer tube 21 includes an engaging hole 211 on a periphery near a top thereof, a first groove section 212 axially arranged along an outer periphery thereof and a first slot hole 213 arranged at near bottom of the first groove section 212.

Figure 6A:
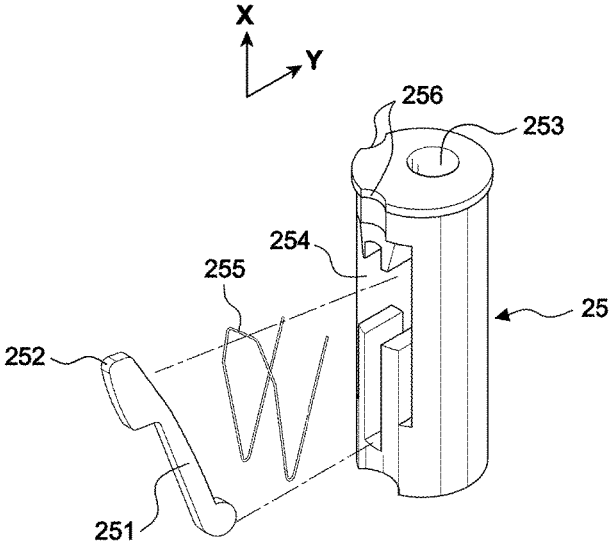
FIG. 6A is an exploded view of a first positioning joint of the present invention.
Figure 6B:
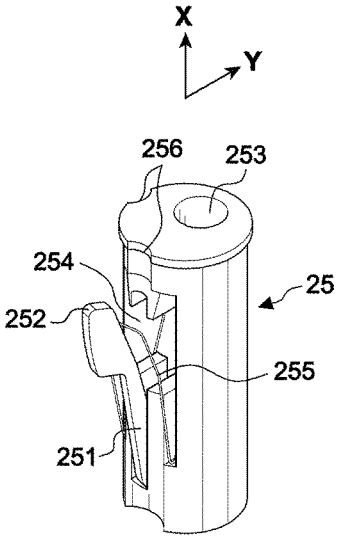
FIG. 6B is a perspective view of the first positioning joint of the present invention.
Figure 6C:
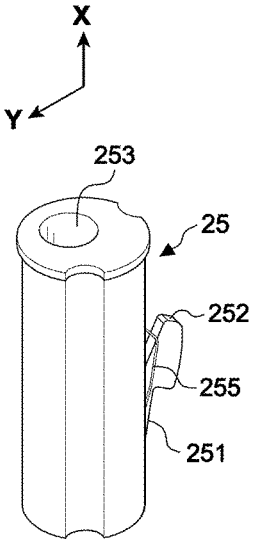
FIG. 6C is a another perspective view of the first positioning joint of the present invention.
Figure 6D:
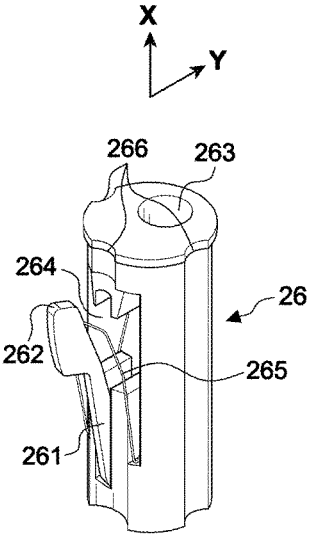
FIG. 6D is a perspective view of a second positioning joint of the present invention.
Figure 7:
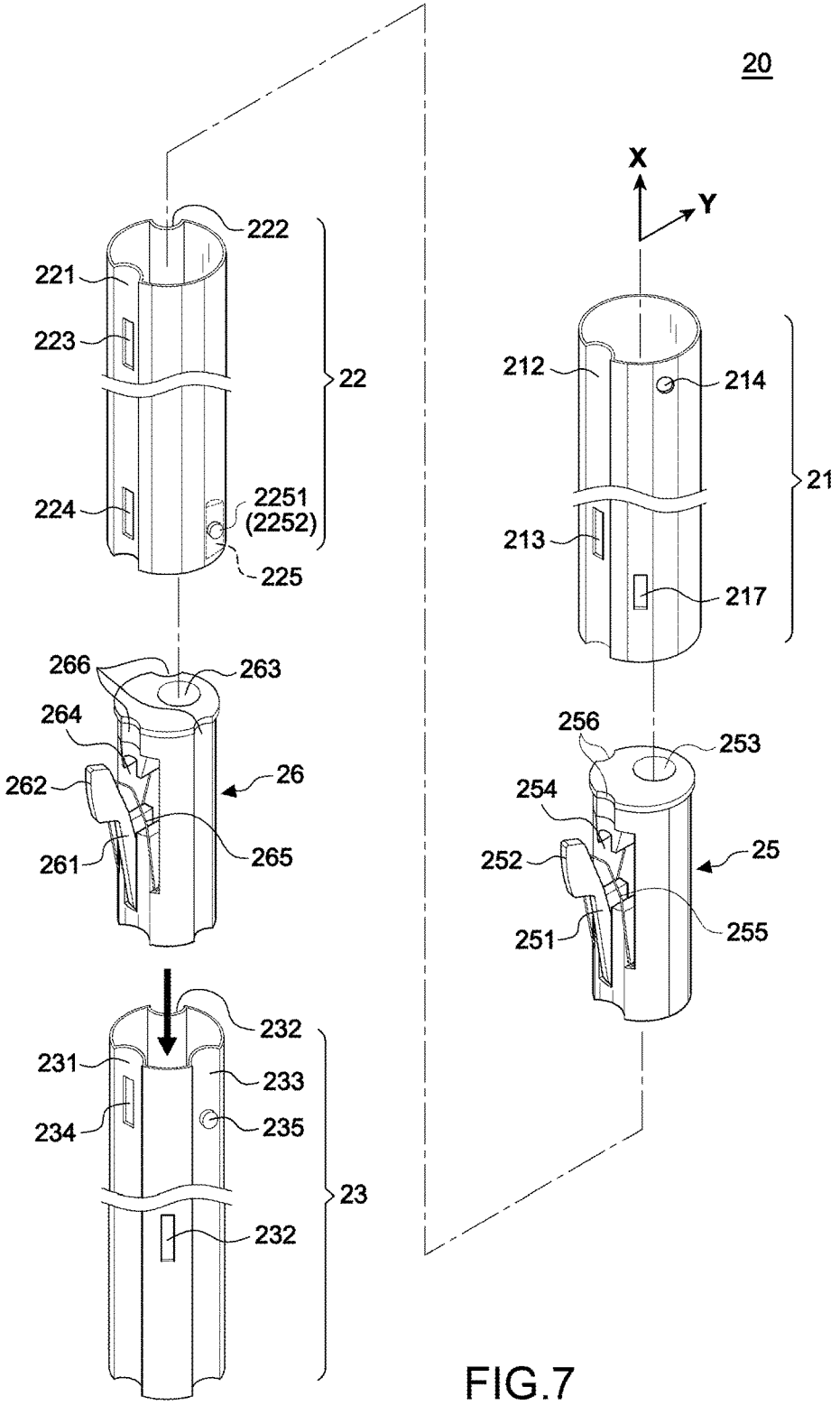
FIG. 7 is an exploded view of the extendable rod of the present invention.
Figure 9:
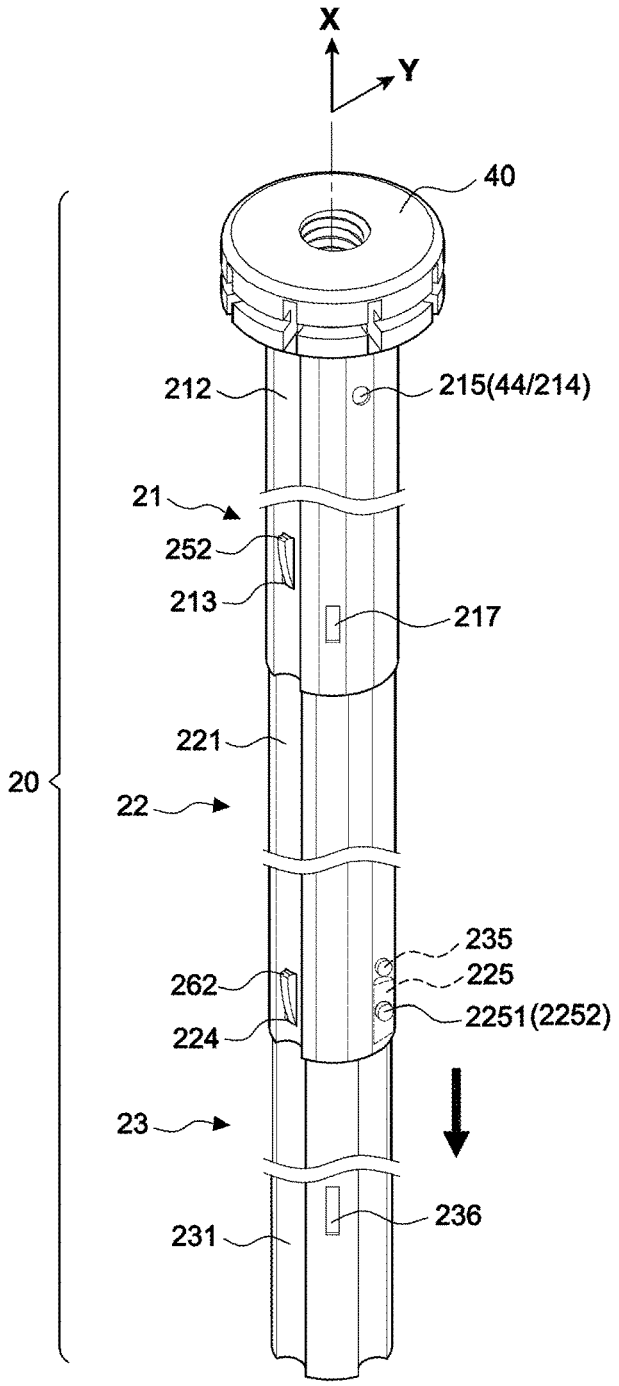
FIG. 9 is a perspective view of the top cap engaged with the extendable rod of the present invention.

Referring to FIGS. 5A and 5B, the intermediate tube 22 is engaged in an inner periphery of the outer tube 21, including a second groove section 221 axially arranged along an outer periphery of the intermediate tube 22 corresponding to the first groove section 212, a third groove section 222 arranged axially along the outer periphery of the intermediate tube 22 and parallel with the second groove section 221, a first through hole 223 arranged near a top of the second groove section 221 corresponding to the first slot hole 213, and a second slot hole 224 arranged near a bottom of the second groove section 221. Further referring to FIGS. 4A and 4B, a first positioning joint 25 is disposed within the intermediate tube 22 at a top thereof. The structure of the first positioning joint 25 is illustrated in FIGS. 6A-6C, including a first axial through-hole 253 and a first clip 251 arranged on a periphery wall thereof. The first clip 251 includes a resilient section 252. In this embodiment, the first positioning joint 25 further includes a first placing space 254 at a side thereof for disposing a first spring element 255, so as to provide elasticity for the resilient section 252 protruding out the first through hole 223 and the second groove section 221 without extending over the periphery of the intermediate tube 22 and engaging the first slot hole 213 of the outer tube 21 for fixing a position as shown in FIG. 9. In this embodiment, the first positioning joint 25 is arranged with two groove sections in accordance with the second and third groove sections 221, 222 if the intermediate tube 22.

Figure 8:
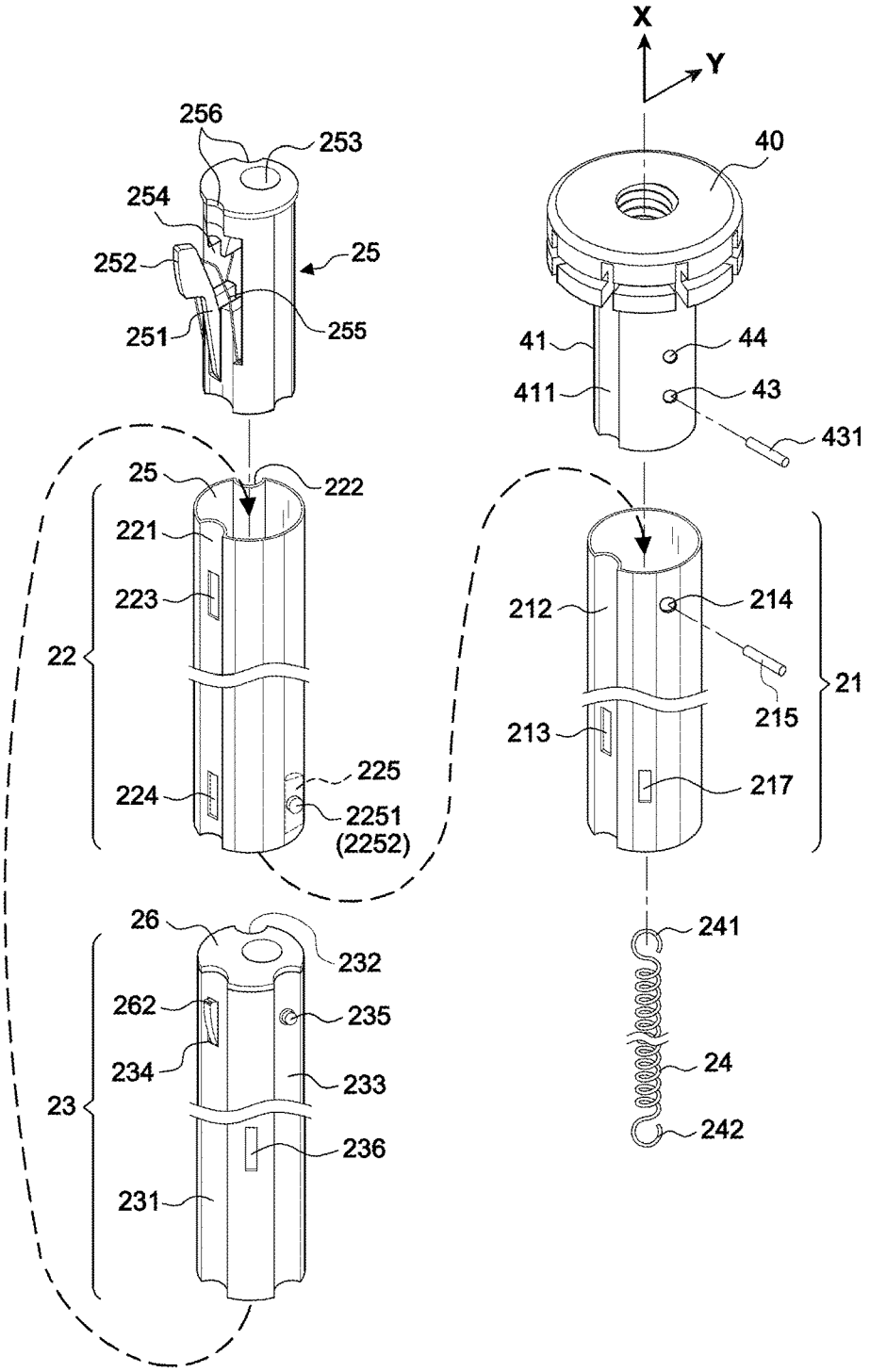
FIG. 8 is an exploded view of a top cap and the extendable rod of the present invention.

Referring to FIGS. 6D-9, the inner tube 23 includes a fourth groove section 231 arranged along an outer periphery thereof corresponding to the second groove section 221, a fifth groove section 232 axially arranged along the outer periphery of the inner tube 23 corresponding to the third groove section 222, a sixth groove section 233 axially arranged along the outer periphery of the inner tube 23, trisecting the outer periphery of the inner tube 23 with the fourth and fifth groove sections 231, 232, a second through hole 234 arranged near a top of the fourth groove section 231 corresponding to the second slot hole 224, and a second positioning joint 26 disposed within the inner tube 23 at a top thereof. The second positioning joint 26 has similar structure with the first positioning joint 25, except for that the shape and size of the second positioning joint 26 is arranged in accordance with the size and shape of the inner tube 23. The second positioning joint 26 includes a second axial through-hole 263 and a second clip 261 arranged on a periphery wall thereof; the second clip 261 further includes a resilient section 262. In this embodiment, the second positioning joint 26 further includes a second placing space 264 at a side thereof for disposing a second spring element 265, so as to provide elasticity for the resilient section 262 protruding out the second through hole 234 and the fourth groove section 231 without extending over the periphery of the inner tube 23. FIGS. 8 and 9 illustrated the second positioning joint 26 engaging the second slot hole 224 of the intermediate tube for fixing a position when the inner tube 23 is engaged with the intermediate tube 22.

Referring to FIGS. 4A, 4B, 10A and 10B, the first spring 24 has a top end 241 passing through the first axial through-hole 253 to fixedly engage in the outer tube 21 and a bottom end 242 passing through the second axial through-hole 263 to fixedly engage in the inner tube 23.

Figure 10A:
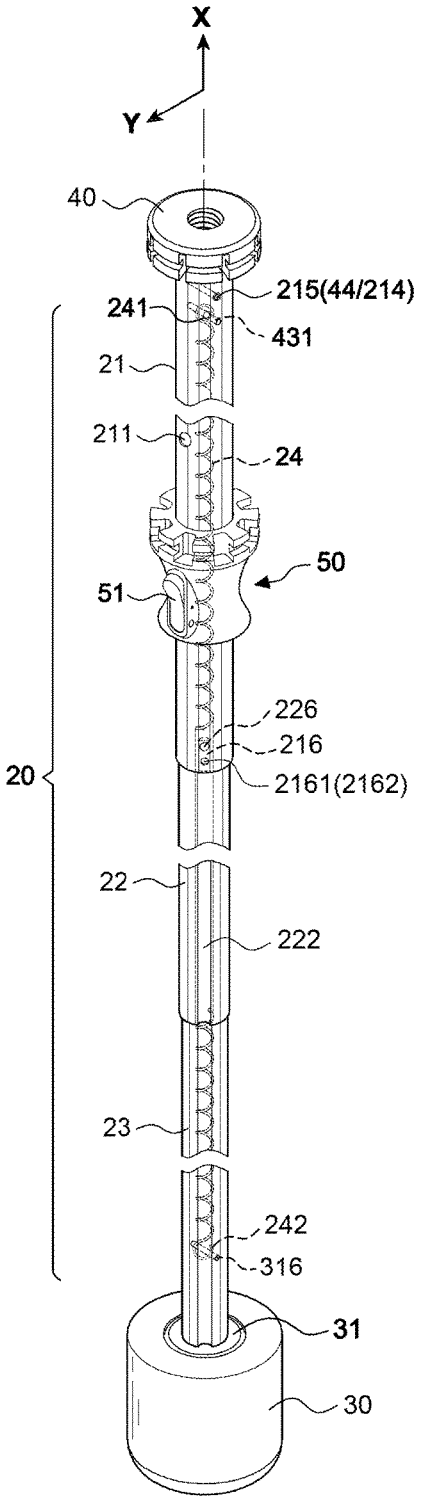
FIG. 10A is a perspective view of FIG. 4A.

Referring to FIGS. 4A and 10A, the handle 30 is engaged a bottom end of the inner tube 23 by a fixing section 31; the fixing section 31 further includes a lower fastening element 311. In this embodiment, the fixing section is fixedly engaged into the handle 30 and the lower fastening element 311 is arranged in accordance with the shape of the inner tube 23 for engaging in a bottom end of the inner tube 23.

Referring to FIGS. 4B, 8 and 9, the top cap 40 is mounted on a top end of the outer tube 21 and including an upper fastening element 41; the upper fastening element 41 further has a seventh groove section 411 arranged along an outer periphery of a lower part of the upper fastening element 41 corresponding to the first groove section 212 of the outer tube 21 for the upper fastening element 41 to be mounted and fixed thereon. In this embodiment, the top end 241 of the first spring 24 is a hook and the upper fastening element 41 further has a first inner hole 42 arranged at a lower part thereof as shown in broken lines of FIG. 4B, a third through hole 43 arranged on an outer periphery thereof and passing through the first inner hole 42, and a first pin 431 disposed through the third through hole 43 and the first inner hole 42 for the top end 241 of the first spring 24 to hook fixedly thereon. In addition, the upper fastening element 41 further includes a fourth through hole 44 arranged above the third through hole 43 on the outer periphery and passing through the first inner hole 42, and the outer tube 21 further includes a fifth through hole 214 at an upper part thereof corresponding to the third through hole 43, thereby a second pin 215 is disposed through the third and fifth through holes 43, 214 for fixing when the upper fastening element 41 is engaged with the outer tube 21. In other words, the top end 241 of the first spring 24 is fixed within the first inner hole 42 of the upper fastening element 41 and then the upper fastening element 41 is engaged in the top of the outer tube 21 in this embodiment.

Figure 10B:
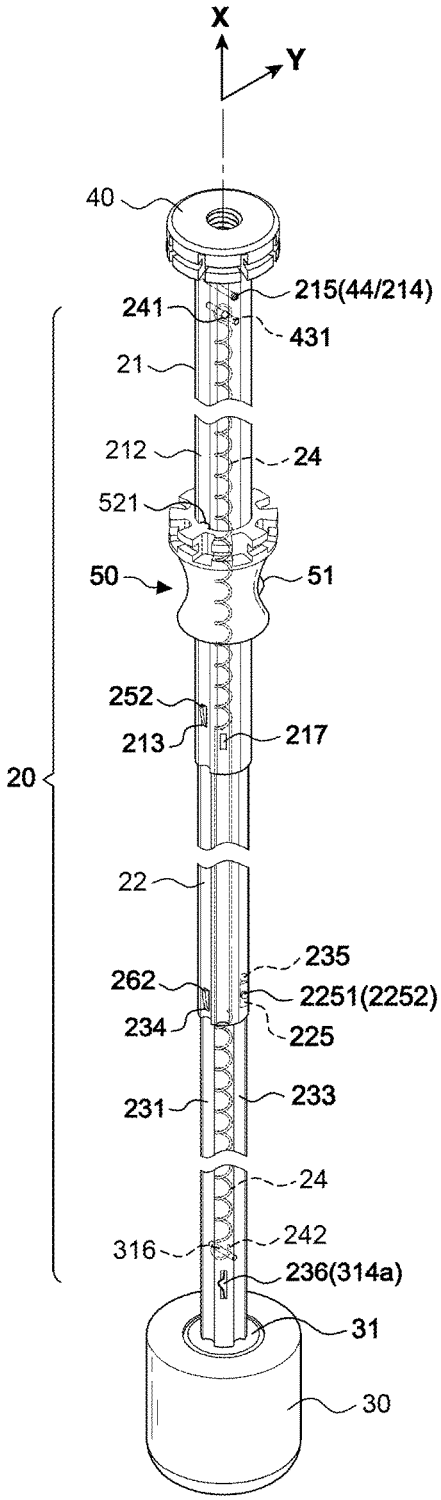
FIG. 10B is a perspective view of FIG. 4B.

Referring to FIG. 4B, the bottom end 242 of the first spring 24 is a hook; the lower fastening element 311 further has a second inner hole 312 corresponding to the first inner hole 42 of the upper fastening element 41, a third placing space 313 axially arranged on an outer periphery of the lower fastening element 311 corresponding to a sixth through hole 236 arranged at a lower end of the inner tube 23, a seventh through hole 315 axially arranged on an outer periphery of the lower fastening element 311 and connecting through the second inner hole 312, and a third pin 316 disposed through the seventh through hole 315 and the second inner hole 312 for the bottom end 242 of the first spring 24 to hook fixedly thereon as shown in FIG. 10B. A clip 314 is disposed in the third placing space 313 and the clip 314 further has a v-shaped protrusion 314*a* elastically protruding out the sixth through hole 236 for operation.

Figure 11A:
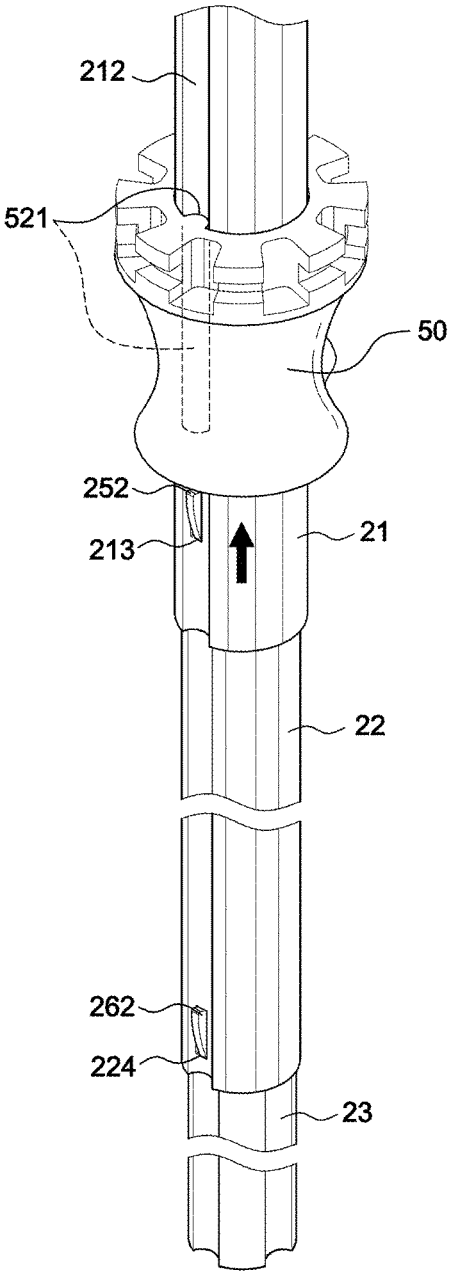
FIG. 11A is a schematic diagram illustrating the retraction of the extendable rod as an outer tube displacing toward a runner according to the present invention.
Figure 11B:
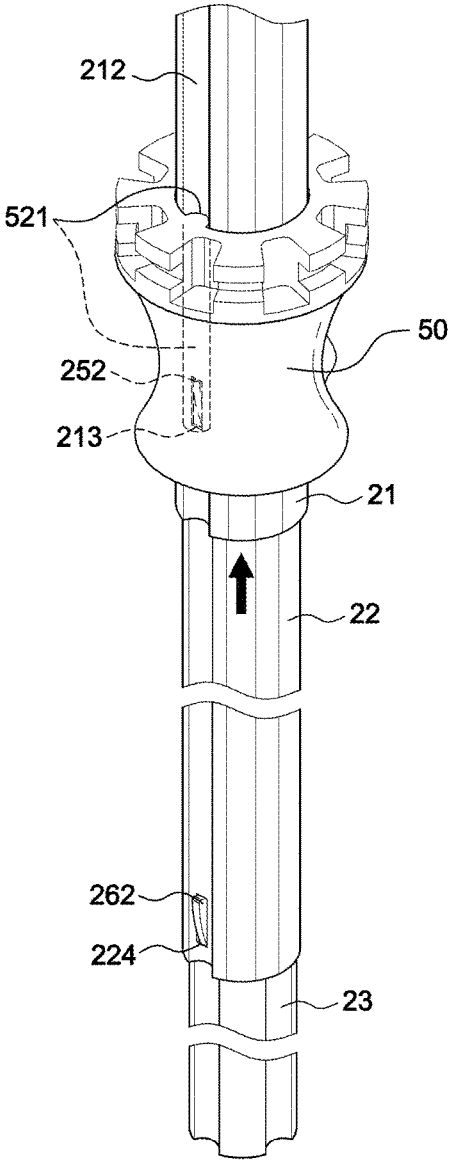
FIG. 11B is a schematic diagram illustrating the retraction of the extendable rod as a resilient section of the first clip detaching from a first slot hole according to the present invention.
Figure 11C:
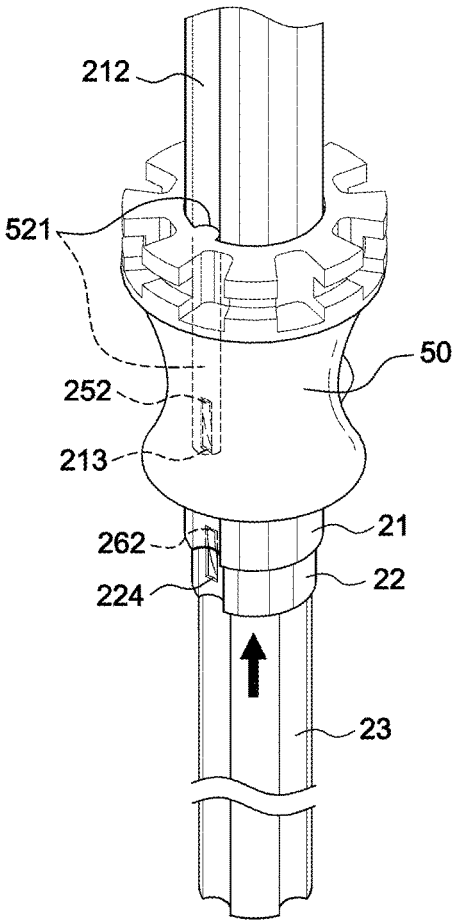
FIG. 11C is a schematic diagram illustrating the retraction of the extendable rod as an intermediate tube retracting into an outer tube according to the present invention.
Figure 11D:
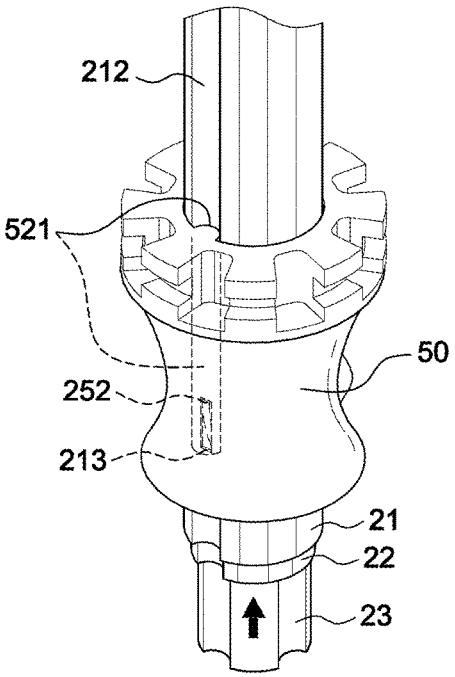
FIG. 11D is a schematic diagram illustrating the retraction of the extendable rod as an inner tube retracting into the intermediate tube according to the present invention.
Figure 12:
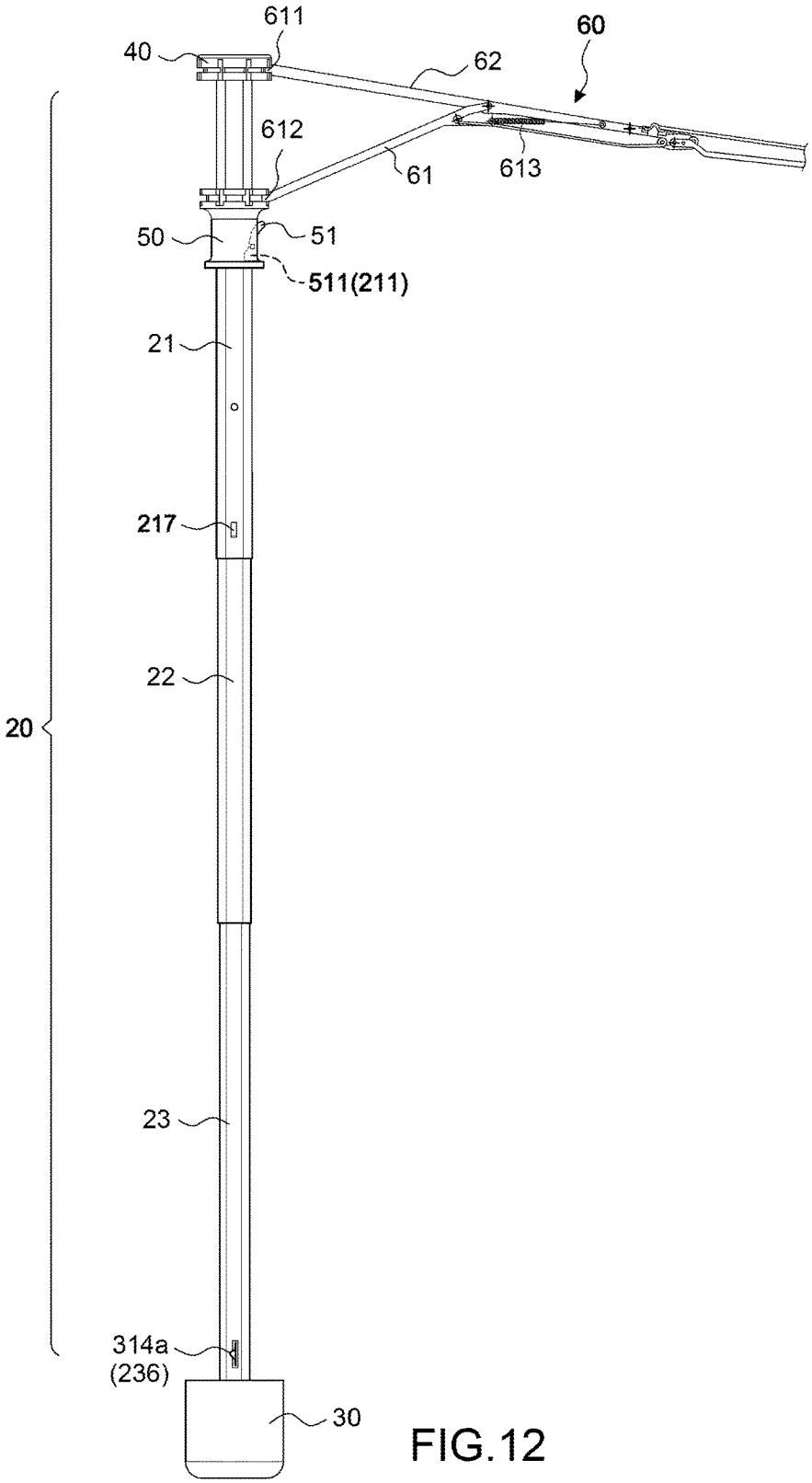
FIG. 12 is a schematic diagram illustrating a fully opened structure according to the present invention.
Figure 13:
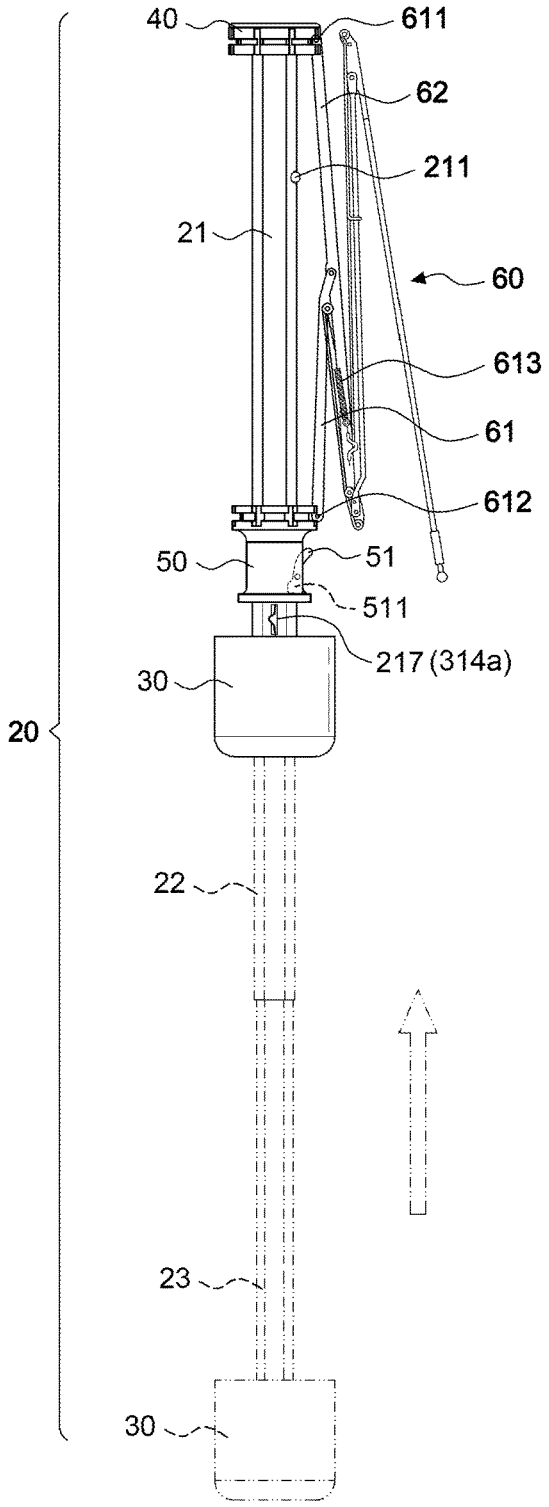
FIG. 13 is a schematic diagram illustrating a fully closed structure according to the present invention.
Figure 14:
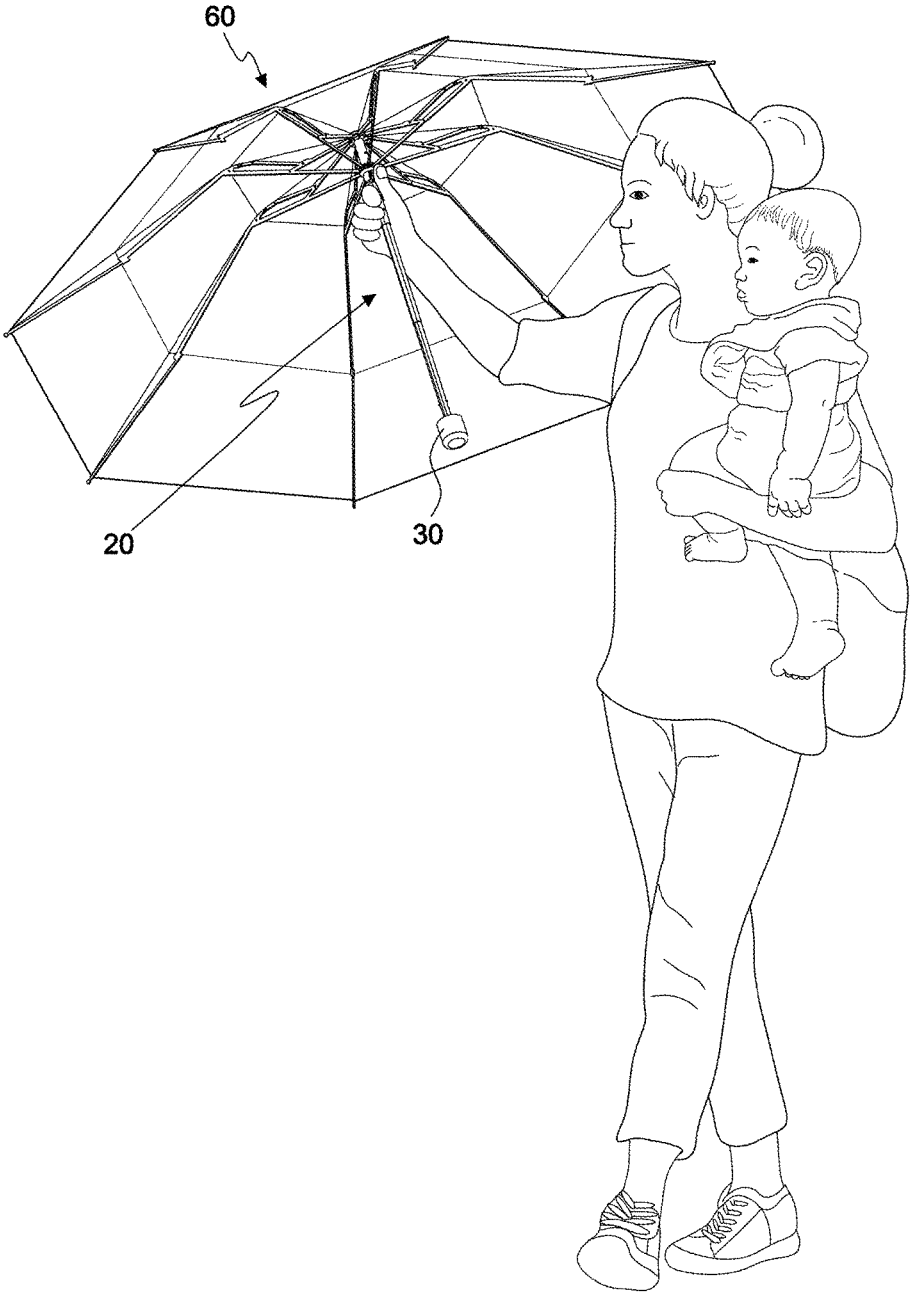
FIG. 14 is a schematic diagram illustrating the present invention ready for closing.

Referring to FIGS. 4A-5B, 11A, 12 and 13, the runner 50 is engaged on the outer peripheral of the outer tube 21 and includes a button 51, a latch 511 arranged at a bottom end of the button 51 for fixing a position of the button 51 when the runner 50 is pushed toward the top cap 40, and an axial protrusion 521 arranged axially along an inner periphery of the runner 50 for pressing the resilient section 252 of the first clip 251 inwardly to be released from the first slot hole 213, thereby retracting a bottom end of the outer tube 21 into the runner 50 and retracting the intermediate tube 22 back into the outer tube 21; then the resilient section 262 of the second clip 261 is pressed inwardly by the intermediate tube 22 to be released from the second slot hole 224, thereby retracting the inner tube 23 into the intermediate tube 22 when the runner 50 slides downwards along the outer tube 21 as shown in FIGS. 11C and 13.

Referring to FIGS. 4A-5B, the upper part 60 includes a plurality of radially arranged ribs 61 and a piece of covering fabric 62. Each rib 61 has a first engaging end 611, a second engaging end 612 and a second spring 613; the first engaging ends 611 are engaged with the top cap 40 and the second engaging ends 613 are engaged with the runner 50.

Since the outer tube 21, the intermediate tube 22, and the inner tube 23 are extendable and retractable, a structure is designed to prevent the tubes from detaching from each other. Referring to FIGS. 4A-5B and 7-9, the intermediate tube 22 further includes a first holding protrusion 226 arranged near a top of the third groove section 222 and the outer tube 21 includes a first positioning piece 216 near a bottom thereof corresponding to the first holding protrusion 226; the first positioning piece 216 is disposed on and displaceable along the third groove section 222. The first positioning piece 216 can be fixed at the bottom of the outer tube 21 in various manufacturing method; in this embodiment, a first positioning hole 2161 is arranged near the bottom of the outer tube 21, and the first positioning piece 216 further includes a protrusion 2162 correspondingly arranged to the first positioning hole 2161 for the protrusion 2162 to engage in the first positioning hole 2161 and then fix a position of the first positioning piece 216 on outer tube 21 as shown in FIG. 8. The inner tube 23 further includes a second holding protrusion 235 near a top of the sixth groove section 233 and the intermediate tube 22 includes a second positioning piece 225 near a bottom thereof corresponding to the second holding protrusion 235; the second positioning piece 225 is disposed on and displaceable along the sixth groove section 233 in the same way as the first positioning piece 216. A second positioning hole 2251 is arranged near the bottom of the intermediate tube 22 and the second positioning piece 225 further includes a protrusion 2252 arranged correspondingly to the second positioning hole 2251 for the protrusion 2252 to engage in the second positioning hole 2251 and then fix a positioning of the second positioning piece 225 on the intermediate tube 23 as shown in FIG. 9.

FIGS. 8 and 9 further illustrated the assembly of the extendable rod 20. When the inner tube 23 engaged with the second positioning joint 26 is disposed into the intermediate tube 22 from a top of the intermediate tube 22, the second holding protrusion 235 is engaged in the sixth groove section 233 without protruding out the periphery of the inner tube 23 as shown in FIG. 8. When the inner tube 23 is fully extended from the intermediate tube 22, the second holding protrusion 235 blocks the second positioning piece 225 to prevent the inner tube 23 from detachment from the intermediate tube 22 as shown in FIG. 9. The intermediate tube 22 is disposed into the outer tube 21 from a top of the outer tube 21 and then the top cap 40 is disposed on the top of the outer tube 21 for fixing, allowing the inner tube 23 to stretch within the intermediate tube 22 and allowing the intermediate tube 22 to stretch within the outer tube 21 with obstruction or detachment.

In this embodiment, the outer tube 21 further includes a third slot hole 217 arranged correspondingly to the sixth through hole 236 and the v-shaped protrusion 314*a*, thereby when operating retraction of the extendable rod 20, the tubes are retracted and the v-shaped protrusion 314*a* protruding out the sixth through hole 236 passes through the intermediate tube 22 and fixedly engages the third slot hole 217, so as to fully retract the extendable rod 20.

Figure 3:
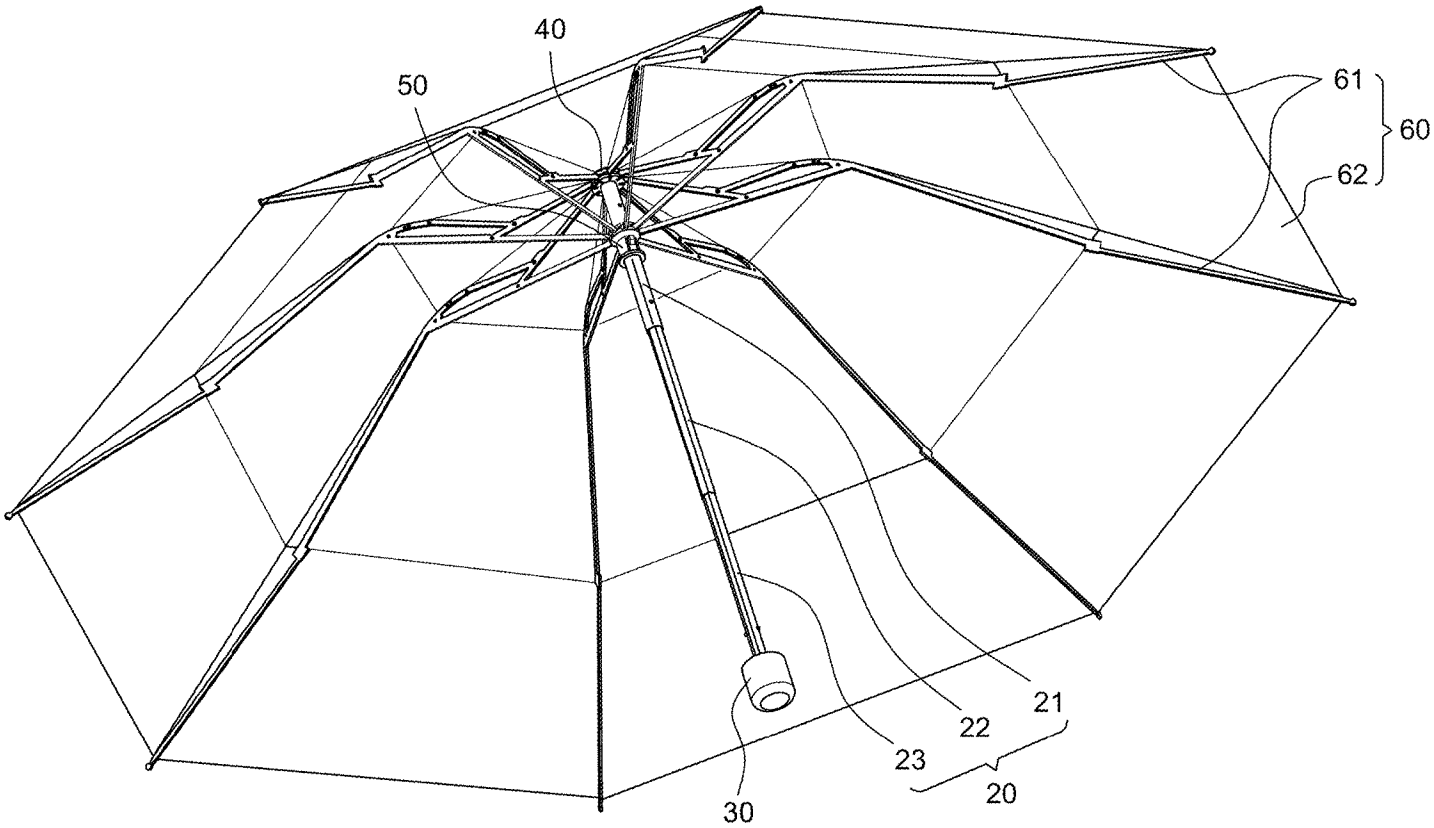
FIG. 3 is a perspective view of the present invention in a preferred embodiment.

With the structure disclosed above, the collapsible umbrella is opened by having the handle 30 held by one hand and the runner 50 pushed by another hand for sliding toward the top cap 40 to displace the plurality of ribs 61 for stretching the second springs 613, displace the outer tube 21 away from the handle 30 and stretch the first spring 24 in the extendable rod 20 until the latch 511 engages in the engaging hole 211 for positioning the runner 50 at a position near a top end of the outer tube 21 as shown in FIG. 12. The resilient section 252 of the first clip 251 engages in the first slot hole 213 as shown in FIG. 10B, so that the intermediate tube 22 is stretched out from the outer tube 21 and the resilient section 262 of the second clip 251 engages in the second slot hole 224 as shown in FIG. 10A, stretching out the inner tube 23 from the intermediate tube 22 and fully extending the extendable rod to unfold the covering fabric and open the collapsible umbrella as shown in FIG. 3.

Figure 15:
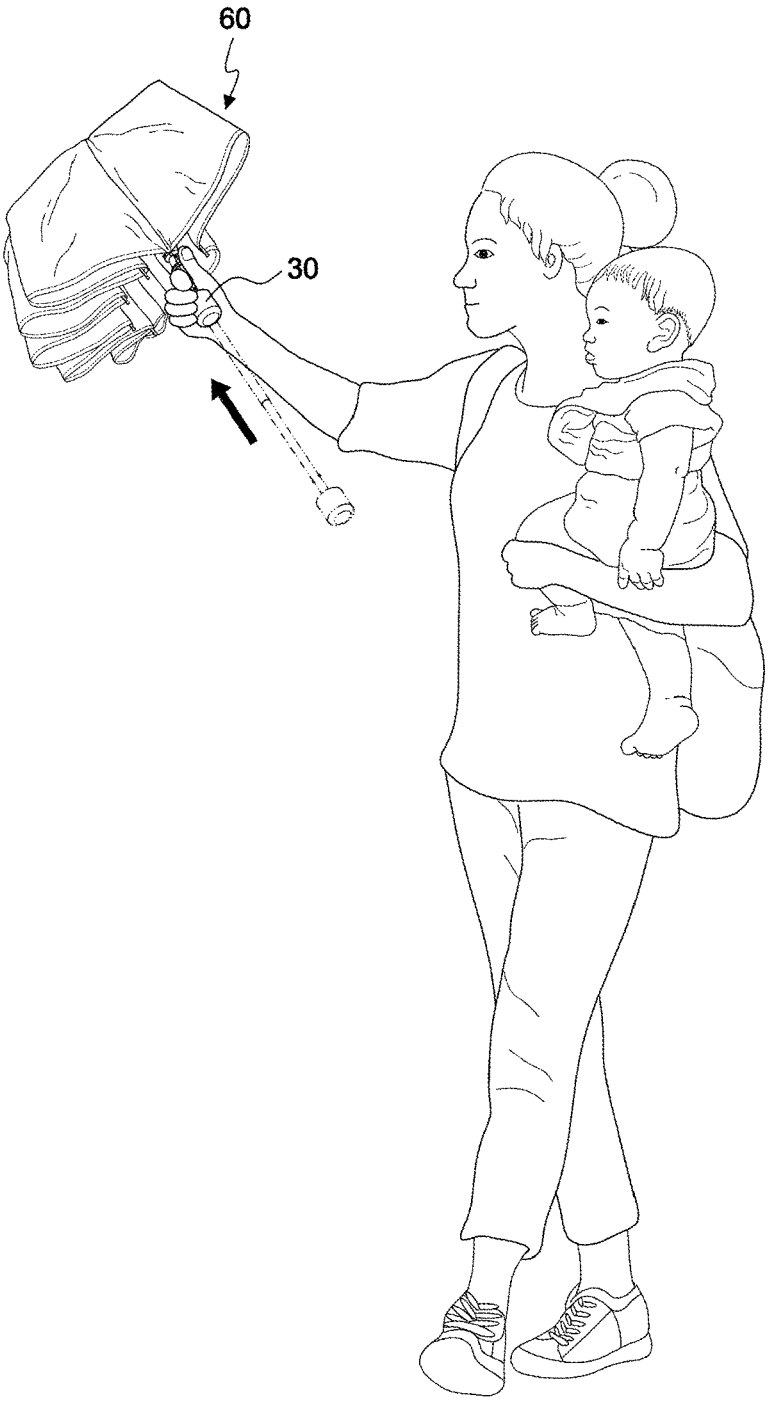
FIG. 15 is a schematic diagram illustrating the present invention after closing.

Referring to FIG. 12, the collapsible umbrella is closed by having one hand holding the runner 50 and pressing the button 51 on the runner 50 to release the engaging status of the latch 511 from the engaging hole 211, retract the second springs 613, and fold back the covering fabric 60; then a bottom end of the outer tube 21 displaces toward the runner 50 as shown in FIG. 11 until the resilient section 252 of the first clip 251 is released from the first slot hole 213 by the axial protrusion 521 of the runner 50 as shown in FIG. 11B and the intermediate tube 22 is retracted back inside the outer tube 21 the first spring 24 as shown in FIG. 11C to fully retract the extendable rod 20 and close the collapsible umbrella as shown in FIGS. 13 and 15.

In conclusion, the outer tube 21 has one groove section; the intermediate tube 22 has two groove sections; and the inner tube 23 has three groove sections for retraction of the extendable rod 20. The runner 50 has the axial protrusion 521 releasing the resilient section 252 of the first clip 251 from the first slot hole 213 for retracting the extendable rod 20. With all the engaging elements arranged in the corresponding groove sections, the extendable rod 20 would not cause injury to the users. Besides, the retraction of the collapsible umbrella is in a direction away from the users, avoiding splashes by the rain and possible injuries by the collapsible umbrella. Still, the collapsible umbrella only requires little elasticity for the retraction of the intermediate tube 22 and the inner tube 23, thereby reducing possible malfunctioning of the present invention with simple structures.

Although particular embodiment of the invention has been described in detail for purposes of illustration, various modifications and enhancements may be made without departing from the spirit and scope of the invention. Accordingly, the invention is not to be limited except by the appended claims.

What is claimed is:

1. A collapsible umbrella with automatic closing structure, comprising:

an extended rod including an outer tube, an intermediate tube, an inner tube, and a first spring, wherein the outer tube includes an engaging hole on a periphery near a top thereof, a first groove section axially arranged along an outer periphery of the outer tube and a first slot hole arranged at near bottom of the first groove section;

the intermediate tube is engaged in an inner periphery of the outer tube and includes a second groove section axially arranged along an outer periphery thereof corresponding to the first groove section, a first through hole arranged near a top of the second groove section corresponding to the first slot hole, a second slot hole arranged near a bottom of the second groove section, a third groove section arranged axially along the outer periphery of the intermediate tube and parallel with the second groove section, and a first positioning joint disposed within the intermediate tube at a top thereof and including a first axial through-hole and a first clip arranged on a periphery wall thereof, said first clip including a resilient section protruding out the first through hole and the second groove section without extending over the periphery of the intermediate tube and engaging the first slot hole of the outer tube for fixing a position when the intermediate tube is retracted within the outer tube;

the inner tube includes a fourth groove section arranged along an outer periphery thereof corresponding to the second groove section, a second through hole arranged near a top of the fourth groove section corresponding to the second slot hole, a fifth groove section axially arranged along the outer periphery of the inner tube corresponding to the third groove section, a sixth groove section axially arranged along the outer periphery of the inner tube, and a second positioning joint disposed within the inner tube at a top thereof, said second positioning joint including a second axial through-hole and a second clip arranged on a periphery wall thereof, said second clip including a resilient section protruding out the second through hole and the fourth groove section without extending over the periphery of the inner tube and engaging the second slot hole of the intermediate tube for fixing a position when the inner tube is retracted within the intermediate tube and the outer tube;

the first spring has a top end passing through the first axial through-hole to fixedly engage in the outer tube and a bottom end passing through the second axial through-hole to fixedly engage in the inner tube;

a handle engaged a bottom end of the inner tube by a fixing section, said fixing section including a lower fastening element;

a top cap mounted on a top end of the outer tube and including an upper fastening element, said upper fastening element further having a seventh groove section arranged along an outer periphery of a lower part of the upper fastening element corresponding to the first groove section of the outer tube for the upper fastening element to be mounted and fixed thereon;

a runner engaged on the outer peripheral of the outer tube and including a button, a latch arranged at a bottom end of the button for fixing a position of the button when the runner is pushed toward the top cap, and an axial protrusion arranged axially along an inner periphery of the runner for pressing the resilient section of the first clip inwardly to be released from the first slot hole, thereby retracting the intermediate tube back into the outer tube, and then pressing the resilient section of the second clip inwardly by the intermediate tube to be released from the second slot hole, thereby retracting the inner tube into the intermediate tube when the runner slides downwards along the outer tube; and an upper part including a plurality of radially arranged ribs and a piece of covering fabric, each rib having a first engaging end, a second engaging end and a second spring, said first engaging ends engaging the top cap and said second engaging ends engaging the runner;

whereby the collapsible umbrella is opened by having the handle held by one hand and the runner pushed by another hand for sliding toward the top cap to displace the plurality of ribs for stretching the second springs, displace the outer tube away from the handle and stretch the first spring in the extendable rod until the latch engages in the engaging hole for positioning the runner at a position near a top end of the outer tube, the resilient section of the first clip engaging in the first slot hole for the intermediate tube to stretch out from the outer tube, and the resilient section of the second clip engaging in the second slot hole for the inner tube to stretch out from the intermediate tube, thereby the extendable rod is fully extended, the covering fabric is unfolded, and the collapsible umbrella is opened; and the collapsible umbrella is closed by having one hand holding the runner and pressing the button on the runner to release the engaging status of the latch from the engaging hole, retract the second springs, and fold back the covering fabric, then a bottom end of the outer tube displacing toward the runner until the resilient section of the first clip being released from the first slot hole by the axial protrusion of the runner and the intermediate tube being retracted back inside the outer tube by the first spring to fully retract the extendable rod and close the collapsible umbrella.

2. The collapsible umbrella with automatic closing structure as claimed in claim 1, wherein the outer tube, the intermediate tube, and the inner tube are circular tubes or polygonal tubes.

3. The collapsible umbrella with automatic closing structure as claimed in claim 1, wherein the top end of the first spring is a hook and the upper fastening element further has a first inner hole arranged at a lower part thereof, a third through hole arranged on an outer periphery thereof and passing through the first inner hole, and a first pin disposed through the third through hole and the first inner hole for the top end of the first spring to hook fixedly thereon.

4. The collapsible umbrella with automatic closing structure as claimed in claim 3, wherein the upper fastening element further includes a fourth through hole arranged above the third through hole on the outer periphery and passing through the first inner hole, and the outer tube further includes a fifth through hole at an upper part thereof corresponding to the third through hole, thereby a second pin is disposed through the third and fifth through holes for fixing when the upper fastening element is engaged with the outer tube.

5. The collapsible umbrella with automatic closing structure as claimed in claim 4, wherein the bottom end of the first spring is a hook and the lower fastening element further has a second inner hole corresponding to the first inner hole of the upper fastening element, a seventh through hole arranged on an outer periphery thereof and passing through the lower fastening element, and a third pin disposed through the seventh through hole and the second inner hole for the bottom end of the first spring to hook fixedly thereon.

6. The collapsible umbrella with automatic closing structure as claimed in claim 1, wherein the intermediate tube further includes a first holding protrusion arranged near a top of the third groove section and the outer tube includes a first positioning piece near a bottom thereof corresponding to the first holding protrusion, displaceable along the third groove section, and a first positioning hole near the bottom of the outer tube, said first positioning piece further including a protrusion arranged correspondingly to the first positioning hole for the protrusion to engage in the first positioning hole and then fix a position of the first positioning piece on outer tube;

the inner tube further includes a second holding protrusion near a top of the sixth groove section and the intermediate tube includes a second positioning piece near a bottom thereof corresponding to the second holding protrusion, displaceable along the sixth groove section, and a second positioning hole near the bottom of the intermediate tube, said second positioning piece further including a protrusion arranged correspondingly to the second positioning hole for the protrusion to engage in the second positioning hole and then fix a positioning of the second positioning piece on the intermediate tube, thereby when the inner tube engaged with the second positioning joint is disposed into the intermediate tube from a top of the intermediate tube, the second holding protrusion is engaged in the sixth groove section without protruding out the periphery of the inner tube and when the inner tube is fully extended from the intermediate tube, the second holding protrusion blocks the second positioning piece to prevent the inner tube from detachment from the intermediate tube; the intermediate tube is disposed into the outer tube from a top of the outer tube and then the top cap is disposed on the top of the outer tube for fixing, allowing the inner tube to stretch within the intermediate tube and allowing the intermediate tube to stretch within the outer tube with obstruction or detachment.

* * * * *